US009640907B2

(12) United States Patent
Kaneko

(10) Patent No.: US 9,640,907 B2
(45) Date of Patent: May 2, 2017

(54) FITTING ADAPTER FOR FITTING A PLURALITY OF CABLE CONNECTORS FROM AN ELECTRIC DEVICE

(71) Applicant: Hirose Electric Co., Ltd., Tokyo (JP)

(72) Inventor: Tsubasa Kaneko, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/731,463

(22) Filed: Jun. 5, 2015

(65) Prior Publication Data

US 2015/0364868 A1 Dec. 17, 2015

(30) Foreign Application Priority Data

Jun. 16, 2014 (JP) ..... 2014-123407

(51) Int. Cl.

| | |
|---|---|
| ***H01R 25/00*** | (2006.01) |
| ***H01R 13/627*** | (2006.01) |
| ***H01R 24/40*** | (2011.01) |
| ***H01R 24/54*** | (2011.01) |

(52) U.S. Cl.

CPC ..... *H01R 13/6275* (2013.01); *H01R 24/40* (2013.01); *H01R 24/542* (2013.01)

(58) Field of Classification Search

CPC .... H01R 13/6275; H01R 24/40; H01R 31/06; H01R 13/6272; H01R 13/6273; H01R 13/639; H01R 13/637

USPC ..... 439/358, 628, 638, 253

See application file for complete search history.

(56) References Cited

U.S. PATENT DOCUMENTS 3,551,874 A * 12/1970 Volinskie ..... H01R 24/542 439/63
4,181,333 A * 1/1980 Stelma ..... E05C 19/14 292/113
4,953,030 A * 8/1990 Seo ..... G11B 31/006 174/138 G
5,984,721 A * 11/1999 Self, Jr. ..... H01R 13/74 439/546
6,144,561 A * 11/2000 Cannella, Jr. ..... H05K 7/1447 361/788
6,146,153 A * 11/2000 Koradia ..... H01R 12/716 439/638

(Continued)

OTHER PUBLICATIONS

"Agilent Millimeter-Wave Network Analyzer 10 MHz to 110 GHz, extendable to 1.1 THz, Technical Overview", Agilent Technologies, Nov. 19, 2013, URL: http://cp.lterature.agilent.com/litweb/pdf/5989-7602JAJP.pdf.

*Primary Examiner* — Tulsidas C Patel
*Assistant Examiner* — Peter G Leigh
(74) *Attorney, Agent, or Firm* — Kubotera & Associates, LLC

(57) ABSTRACT

A fitting adaptor is for fitting a cable connector to a device connector of an electrical device. The fitting adaptor includes a panel; an intermediate connector attached to the panel to be movable relative to the panel; a locking mechanism disposed on the panel; and an elastic member disposed on at least one of the intermediate connector and the locking mechanism, or between the panel and the intermediate connector. The intermediate connector includes a cable connector side connecting portion and a device connector side connecting portion, so that the elastic member urges the device connector side portion against the device connector.

6 Claims, 7 Drawing Sheets

(56) References Cited

U.S. PATENT DOCUMENTS

| | | | | |
|---|---|---|---|---|
| 6,176,743 | B1 * | 1/2001 | Kuo | H01R 31/06 439/638 |
| 6,319,066 | B2 * | 11/2001 | Kuo | 439/638 |
| 6,343,957 | B1 * | 2/2002 | Kuo | H01R 31/06 439/362 |
| 6,402,565 | B1 * | 6/2002 | Pooley | H01R 9/0515 439/347 |
| 6,719,591 | B1 * | 4/2004 | Chang | H01R 27/02 439/638 |
| 6,767,253 | B1 * | 7/2004 | Werner | H01R 27/00 348/E5.128 |
| 7,053,643 | B2 * | 5/2006 | Ruff | G01R 1/06788 324/72.5 |
| 7,133,285 | B2 * | 11/2006 | Nishimura | H05K 5/0265 165/185 |
| 7,878,859 | B2 * | 2/2011 | Zhu | H01R 13/512 439/638 |
| 7,922,526 | B2 * | 4/2011 | Okada | G03B 17/00 439/544 |
| 2005/0250379 | A1 * | 11/2005 | Coffey | H01R 13/741 439/544 |
| 2015/0126061 | A1 * | 5/2015 | Paynter | H01R 13/6315 439/567 |

* cited by examiner

FITTING ADAPTER FOR FITTING A PLURALITY OF CABLE CONNECTORS FROM AN ELECTRIC DEVICE

BACKGROUND OF THE INVENTION AND RELATED ART STATEMENT

The present invention relates to a fitting adapter for fitting a plurality of cable connectors to a plurality of connectors provided in an electronic device including a frequency extender (hereinafter also referred to as a VNA extender), which is to be used by connecting to a measurement device such as a vector network analyzer (VNA) when high-frequency characteristics of electronic devices are measured in a wide frequency range from low to high frequencies.

Conventionally, the VNA is used to measure high-frequency characteristics (or frequency characteristic) of electronic components, circuits, or the like of the electronic devices as a measurement object. When the high-frequency characteristics of the device are measured, frequencies of signals are adjusted within a set frequency range of the VNA and the signals are output to the electronic device as a measurement object.

In addition, in order to produce high-frequency signals beyond the adjustable frequency range of the VNA, a VNA extender is used. The VNA extender is connected to the VNA through a plurality of cables. When the frequencies of the output signals of the VNA are amplified to even higher frequencies and the high-frequency signals are output to the electronic device as a measurement object, it is possible to more accurately measure the high-frequency characteristics of the electronic device as a measurement object.

In order to produce the high-frequency signals having different frequencies, it is necessary to reconnect the VNA extender connected to the VNA to another VNA extender. For example, as described in Non-Patent Reference, there are various types of VNA extenders (frequency extenders). Reconnecting a plurality of types of VNA extenders to the VNA, it is possible to measure the high-frequency characteristics within a wide range using a plurality of high-frequency signals.

Non-Patent Reference: "Agilent Millimeter-Wave Network Analyzer 10 MHz to 110 GHz, extendable to 1.1 THz, Technical Overview", Agilent Technologies, Nov. 19, 2013, [Online search on Jun. 12, 2014], internet (URL: http://cp.lterature.agilent.com/litweb/pdf/5989-7602JA-JP.pdf)

However, in order to reconnect the electronic devices such as the VNA extenders, it is necessary to reconnect a plurality of cables. Therefore, in each reconnection, it is necessary to fasten coaxial connectors of the plurality cables and coaxial connectors on the side of the VNA extender (electronic device) by screwing action, thereby taking a long time to reconnect the VNA extenders.

In addition, when a plurality of cables is reconnected, it is necessary to confirm stability of the high-frequency characteristics of the cable connections before measuring the high-frequency characteristics of the electronic device as a measurement object. In order to obtain stable characteristics in the cable connection itself, it is necessary to connect the cables so as to securely contact outer conductors of the coaxial connectors on the side of VNA extender with outer conductors of the coaxial connectors on the cable side (hereinafter, referred to as end-touching connection).

Furthermore, when the VNA extender is reconnected to the plurality of cables, the cable-side coaxial connector may be mistakenly connected to a wrong coaxial connector on the side of the VNA extender, thereby damaging the VNA extender itself due to such erroneous connection.

FIG. 7 is a perspective view showing an example of the conventional VNA extender 200, which is one of the conventional frequency extenders. The conventional VNA extender 200 includes a cable connection panel 202 on one side surface of a box-like housing thereof. On the cable connection panel 202, there is provided a plurality of extender connectors, each of which is connected to a coaxial connector 301 of a plurality of cables 300.

In the conventional VNA extender 200, when the coaxial connectors 301 of the cables 300 are connected by tightening threaded fastening parts 302 while controlling torque upon fastening, it is achievable to maintain and secure the connection to the extender connectors 204 and thereby to secure an end-touching state. On the cable connection panel 202, there are further provided a power source connector 206, and a heating portion 208 composed of a plurality of heat release plates.

Conventionally, in order to measure the high-frequency characteristics of the electronic components in a wide range, circuits or the like as a measurement object such as electronic devices, the VNA extender is replaced with another VNA extender several times. For this reason, whenever the VNA extender is to be replaced, it is necessary to remove and attach the VNA extender by rotating the threaded fastening parts 302 of the coaxial connectors 301 of the plurality of cables 300.

In order to solve such problems, an object of the present invention is to provide a fitting adapter, which does not require individually reconnecting a plurality of cables, upon connecting to an electronic device that has a plurality of connectors and requires reconnection of cables thereto, such as a VNA extender. In addition, according to the fitting adapter of the present invention, it is possible to securely connect the connectors in end-touching state all together.

Further objects and advantages of the present invention will be apparent from the following description of the present invention.

SUMMARY OF THE PRESENT INVENTION

In order to attain the objects described above, according to a first aspect of the present invention, a fitting adapter is for fitting and connecting a plurality of cable connectors to a plurality of device connectors of an electronic device together. The fitting adapter includes a plurality of intermediate connectors; a locking mechanism; and at least one elastic member.

According to the first aspect of the present invention, the plurality of intermediate connectors is provided on a flat panel. The locking mechanism is provided to maintain and secure a connected state of connectors when the plurality of intermediate connectors are fitted and connected to the plurality of device connectors. At least one elastic member is provided on at least one of the locking mechanism, the intermediate connectors, and between the intermediate connectors and the panel. The elastic member produces elastic force in connector's fitting direction. Each of the plurality of intermediate connectors penetrates the panel and is attached thereto in a floating state. Each of the plurality of intermediate connectors has a cable connector-side connecting part for connecting to a cable connector at one end and a device connector-side connecting part for connecting to the electronic device at the other end. Being maintained and secured by the locking mechanism, elastic force is produced in a direction that the plurality of device connectors and outer conductors of the device connector-side connecting parts of the plurality of intermediate connectors push each other.

According to a second aspect of the present invention, the locking mechanism is a pull-in lock composed of a pull ring and a lever. The pull-in lock includes a coil spring as an elastic member so as to generate elastic force in the connector's fitting direction. Hooking the pull ring onto an engaging portion provided in an electronic device and pulling down the lever, elastic force is generated by the coil spring in the directions of fitting the plurality of device connectors to the device connector-side connecting parts of the plurality of intermediate connectors.

According to a third aspect of the present invention, in the fitting adapter, the locking mechanism is an engaging portion to lock the pull-in lock provided in the electronic device. The engaging portion is configured to produce an elastic force by the coil spring provided in the pull-in lock in direction of fitting the plurality of device connectors to the device connector-side connecting parts of the plurality of intermediate connectors.

According to a fourth aspect of the present invention, in a preferred embodiment of the fitting adapter, the elastic member is provided between the intermediate connectors and the panel.

According to a fifth aspect of the present invention, in a preferred embodiment of the fitting adapter, the panel includes at least an anti-reverse attachment preventing portion, which is formed in a shape so as to prevent vertically or horizontally reverse attachment of the fitting adapter.

According to a sixth aspect of the present invention, in a preferred embodiment of the fitting adapter, the electronic device includes a heating portion for releasing heat inside the electronic device on the same surface as a surface having the plurality of device connectors. The panel has a flat heat guard at a position that faces the heating portion, so as to block heat or hot air generated from the heating portion.

According to a seventh aspect of the present invention, in a preferred embodiment of the fitting adapter, the electronic device is a frequency extender. According to the fitting adapter of the present invention, coaxial connectors of cables are respectively connected to cable connector-side connecting parts provided at one ends of the plurality of intermediate connectors provided on a flat panel. In this state, the device connector-side connecting parts provided at the other ends of the plurality of intermediate connectors are fitted and connected to the plurality of device connectors of the frequency extender. As a result, it is achievable to reduce the amount of work involved in reconnection of cables accompanied by replacement of an electronic device. In addition, the coaxial connectors of the plurality of cables are respectively connected to the plurality of intermediate connectors of the fitting adapter in advance. As a result, upon reconnecting cables, it is possible to eliminate risk of connecting a coaxial connector of an individual cable to a wrong connector.

Furthermore, according to the present invention, the fitting adapter is provided with at least one elastic member, which is provided at least one of the locking mechanisms, the intermediate connectors, and between the intermediate connectors and the panel, and generates the elastic force in the connectors' fitting direction. With the elastic member (bodies), the plurality of device connectors and device connector-side connecting parts of the plurality of intermediate connectors are fitted and connected to each other while pushing each other. Therefore, the outer conductors of the device connectors and the outer conductors of the intermediate connectors can always contact each other, i.e., it is possible to achieve secure end-touching state. Accordingly, high-frequency characteristics of the cable connection itself can be always stable, and it is achievable to accurately conduct measurements of high-frequency characteristics of an object to measure.

DETAILED DESCRIPTION OF THE PREFERRED EMBODIMENTS

Figure 1:
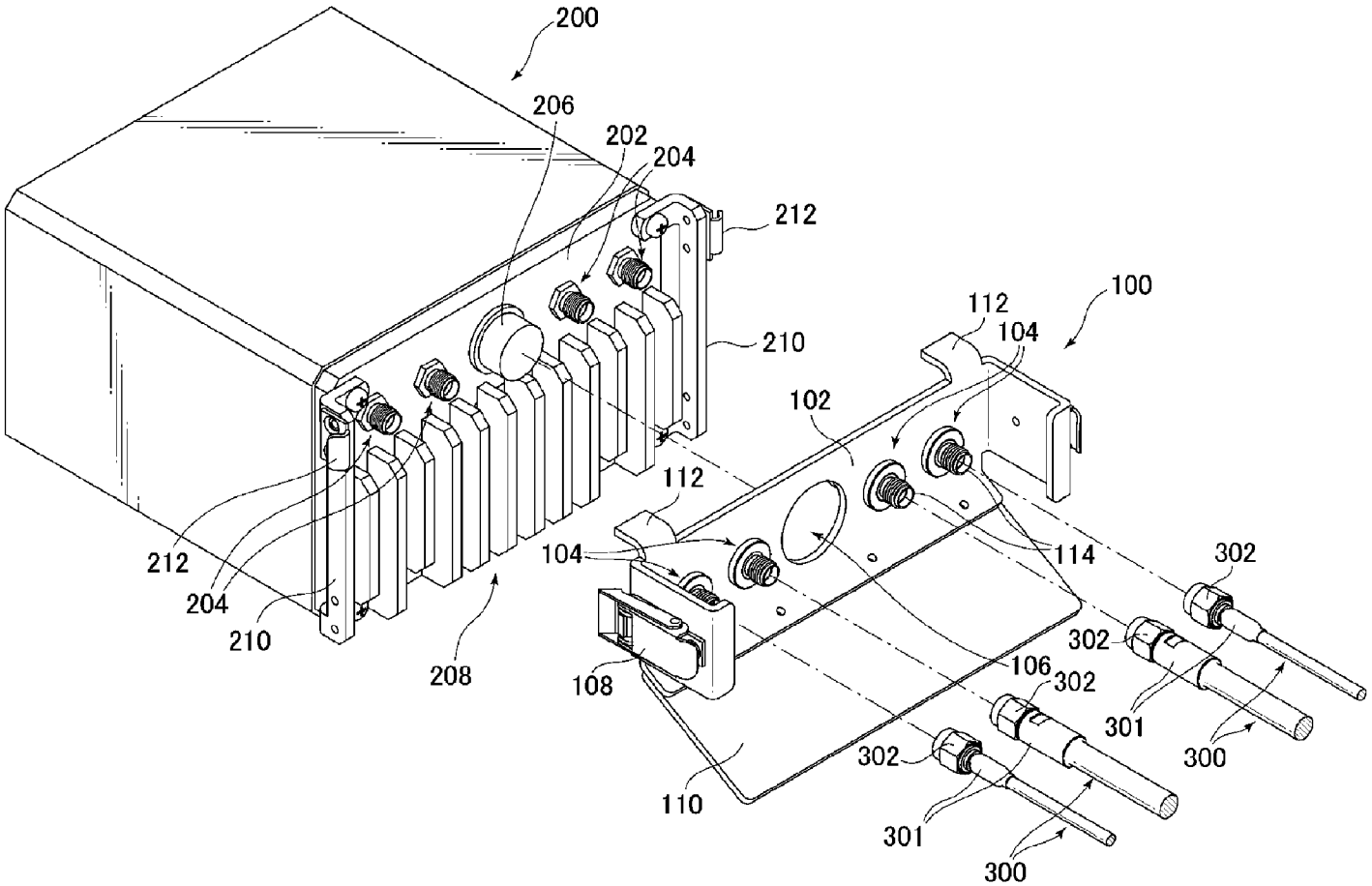
FIG. 1 is a perspective view showing a configuration of a fitting adapter, a VNA extender, and a plurality of cables according to a first embodiment of the present invention.

Hereunder, embodiments of the present invention will be described with reference to the accompanying drawings.

In this description, a VNA extender will be used as an example of an electronic device that is equipped with a plurality of connectors and requires reconnection. Here, in any figures that describe the embodiments, basically the same reference numerals are assigned with the same reference numerals, and explanations thereof are omitted.

First Embodiment

In order to avoid the problems described above, a first embodiment of the present invention will be explained with reference to FIGS. 1 to 5.

FIG. 1 is a perspective view showing a configuration of a fitting adapter, a VNA extender, and a plurality of cables, according to an embodiment of the present invention. The fitting adapter 100 includes a flat panel 102, a plurality of intermediate connectors 104, and an opening 106. The plurality of intermediate connectors 104 is provided to penetrate the panel 102. The opening 106 is provided in the center of the panel 102 for putting a power source connector 206 of the VNA extender 200 and a power cable therethrough to connect to the power source 206. In addition, the fitting adapter 100 includes pull-in locks 108, and a heat guard 110. The pull-in lock is a locking mechanism provided on both side ends of the panel 102. The heat guard 110 has a flat rectangular shape, and protects the cables 300 from heat or hot air emitted from the heating portion 208 of the VNA extender 200. The heat guard 110 is provided at a lower edge of the panel 102. Moreover, the fitting adapter 100 includes anti-reverse attachment preventing portion 112 on an upper end of the panel 102. The parts to prevent reverse attachment are formed in shapes so as to prevent vertically or horizontally reverse attachment of the fitting adapter 100.

The plurality of intermediate connectors 104 is attached to the panel 102, respectively penetrating the panel 102 and being in a slightly movable state (hereinafter, referred to "floating state") within a range to be able to connect to the plurality of extender connectors 204 of the VNA extenders 200. In order to cause elastic force in a connectors' fitting direction, it is also possible to dispose spring washers 105 (see FIG. 3) as elastic bodies between the intermediate connectors 104 and the panel 102. Since the plurality of intermediate connectors 104 is attached in their floating state, it is achievable to absorb displacement (errors) in arrangement of the extender connectors 204, which could occur when the plurality of VNA extenders 200 are used in measurement of high-frequency characteristics. In addition, it is achievable to solve poor connection between the VNA extender 200 and the fitting adapter 100, which could occur by displacement in arrangement of the extender connectors 204. Moreover, each intermediate connector 104 has a cable connector-side connecting part 114 on its one end, and an extender connector-side connecting part 116 (see FIG. 3) on the other end thereof.

According to the embodiment of the fitting adapter of the present invention that is shown in FIG. 1, the pull-in locks 108, the heat guard 110, and the parts for preventing reverse attachment 112 are respectively provided on both left and right ends and a lower and upper edges of the cable connection panel 202. However, the pull-in locks 108, the heat guard 110, and the parts for preventing reverse attachment 112 can be provided anywhere as long as they can function as intended and can be respectively provided at one or more locations.

The heat guard 110 can be attached at a position of the panel 102 so as to face the heating portion 208 of the VNA extender 200 and protect from heat or hot air from the heating portion 208. In order to protect the cables 300 from heat, it is possible to suitably adjust an angle to attach the heat guard 110 as necessary.

Figure 6:
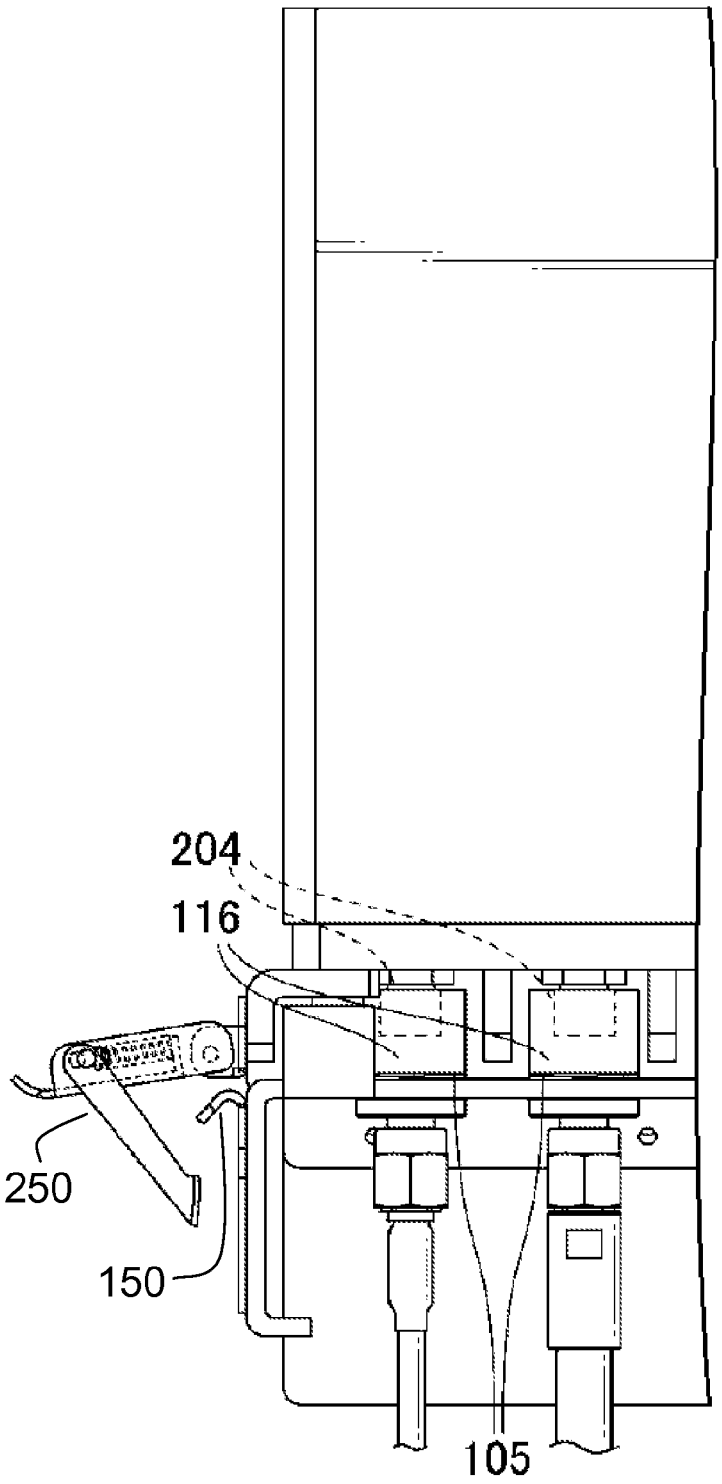
FIG. 6 is a top view showing a fitting adapter connected to a VNA extender according to a second embodiment of the present invention.
Figure 7:
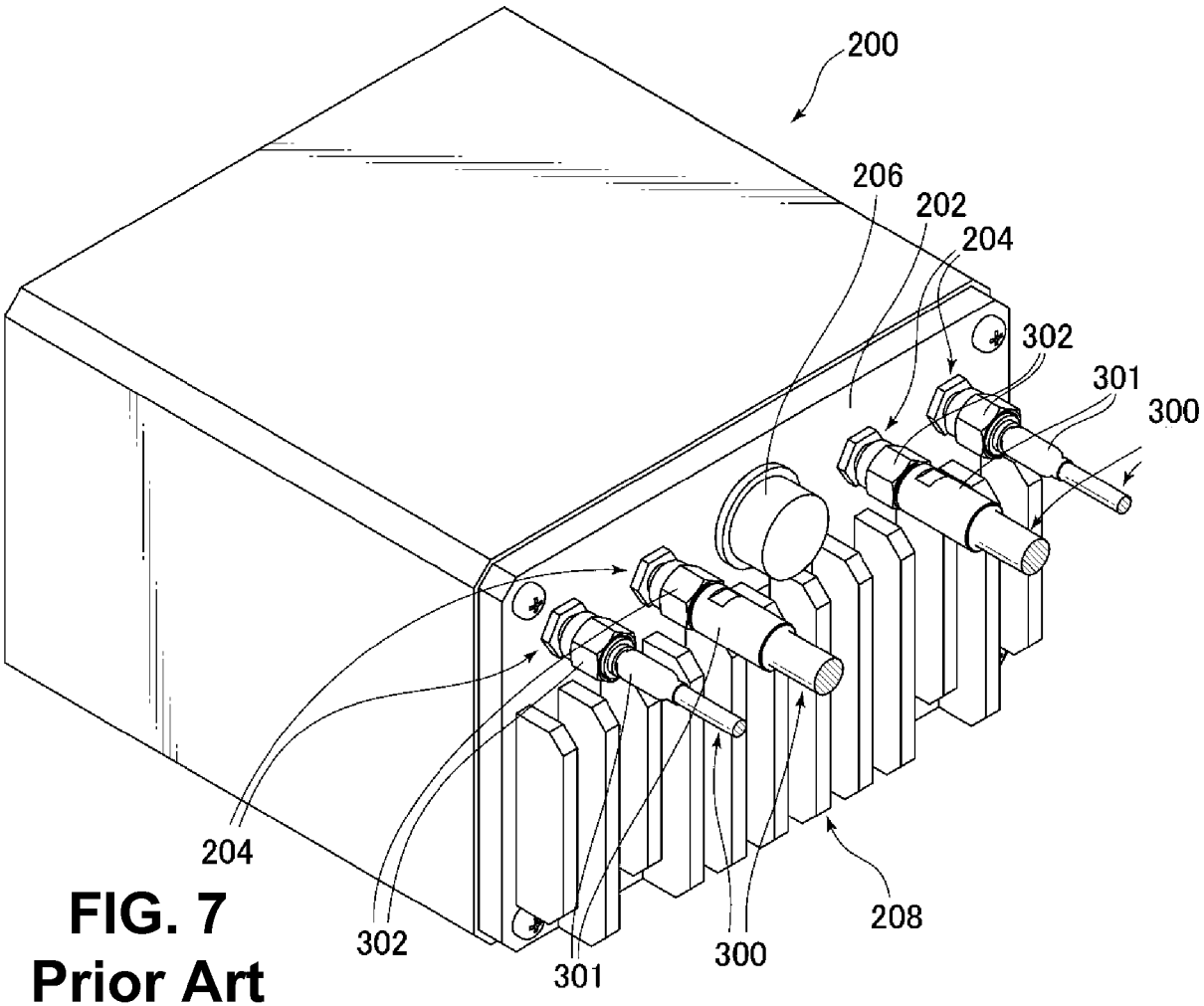
FIG. 7 Prior Art
FIG. 7 is a perspective view showing an example of a conventional configuration of connecting a plurality of cables to a VNA extender.

The VNA extender 200 has a conventional configuration composed of the cable connection panel 202, the plurality of extender connectors 204, the power source connector 206, and the heating portion 208, which is shown in FIG. 6. The VNA extender 200 further includes sidebars 210 at side ends of the cable connection panel 202. On each sidebar 210, there is provided an engaging portion 212. Each engaging portion 212 is a locking mechanism that works in a pair with the pull-in lock 108 of the fitting adapter 100. Each pull-in lock 108 includes a pull ring to hook onto the engaging portion 212 and a lever to secure the hooking state. The positions of the sidebars 210 and the engaging portions 212 on the cable connection panel 202 may be changed according to positions of the pull-in locks on the fitting adapter 100.

According to the first embodiment of the present invention, in the fitting adapter of shown in FIG. 1, the pull-in locks 108 and the engaging portions 212, which are the locking mechanisms, are respectively provided on the fitting adapter 100 and the VNA extender 200. However, instead, it is also possible to provide the engaging portions 212 on the fitting adapter 100 and the pull-in locks 108 on the VNA extender 200.

Figure 5:
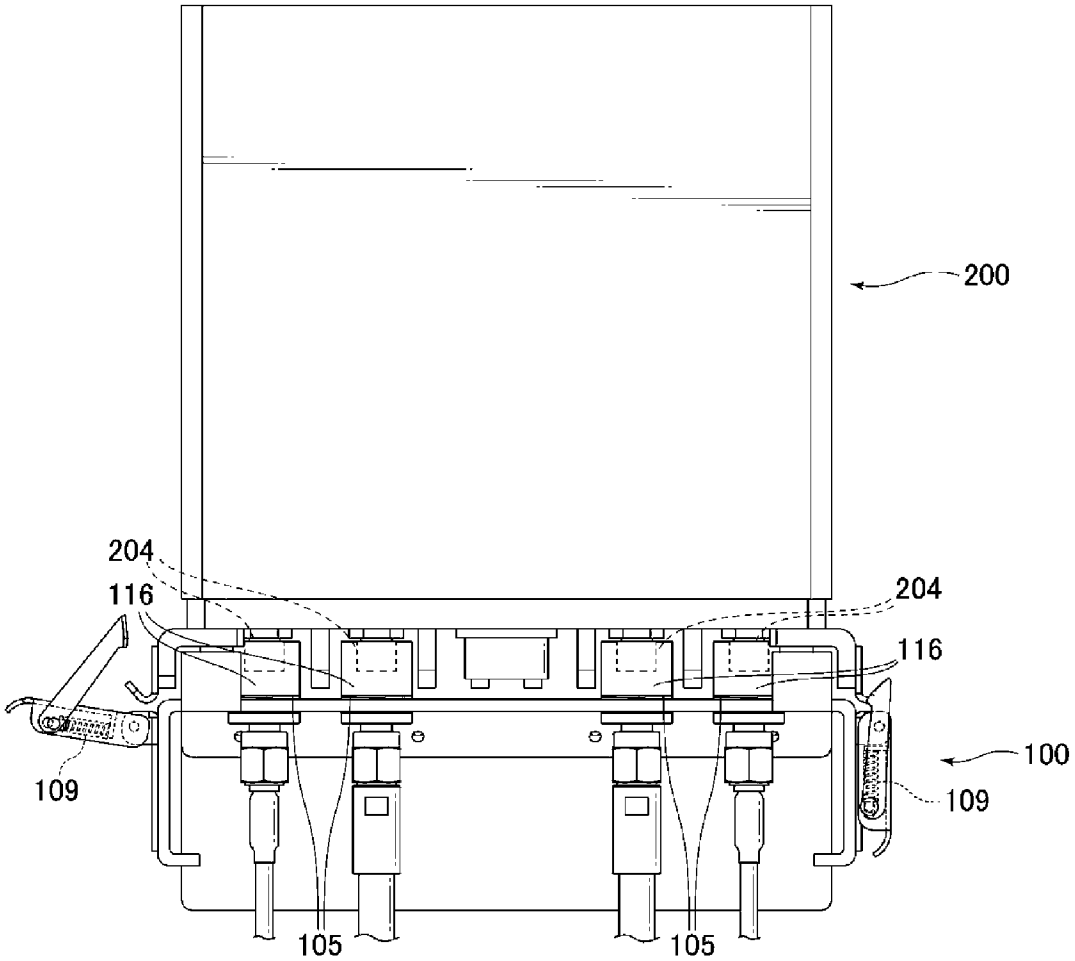
FIG. 5 is a top view showing the fitting adapter connected to the VNA extender according to the first embodiment of the present invention.

In addition to or instead of the configuration of having spring washers 105 or rubber pieces as elastic bodies between the intermediate connectors 104 and the panel 102, it is also possible to provide other elastic member such as coil spring or rubber piece on one or both of the pull-in locks 108 and the engaging portions 212 so as to have elastic force in a direction that the pull-in locks 108 and the engaging portions 212 of the locking mechanism pull each other (see FIG. 5). Accordingly, it is achievable to obtain the configuration, in which the plurality of extender connectors 204 and the plurality of the intermediate connectors 104 of the fitting adapter 100 always push each other by the elastic force of the elastic bodies provided in the locking mechanism. In other words, the plurality of intermediate connectors 104 are respectively fitted and connected to the plurality of extender connectors 204, and even after hooking the pull rings of the pull-in locks 108 onto the engaging portions 212 and pulling down the lever to lock, the force to press each other works between the extender connectors 204 and the intermediate connectors 104, which are fitted and connected to each other, by the elastic bodies of the locking mechanism. Accordingly, it is achievable to secure the end-touching connection.

Furthermore, as another embodiment of providing an elastic member that generates elastic force on the fitting adapter 100 in the connectors' fitting direction, it is also possible to provide an elastic member such as a coil spring or rubber piece in an inner structure of the intermediate connector 104 itself so as to have an outer conductor 122 of each intermediate connector 104 (see FIG. 3) be able to elastically displace in the fitting direction. As a result, it is possible to always generate force that pushes the outer conductors 122 of the intermediate connectors 104 into the outer conductors 216 of the extender connectors 204 upon fitting the connectors.

As described above, in the fitting adapter 100, the elastic bodies can be provided in the locking mechanisms (the pull-in locks 108 and the engaging portions 212) themselves, the intermediate connectors 104 themselves, and between the intermediate connectors 104 and the panel 102. However, locations to provide the elastic bodies can be any, as long as the elastic member is provided in at least one of those locations. Here, if it is possible to stably keep and secure the connection between the extender connectors 204 and the intermediate connectors 104, it is not necessary to provide the elastic bodies.

Figure 2:
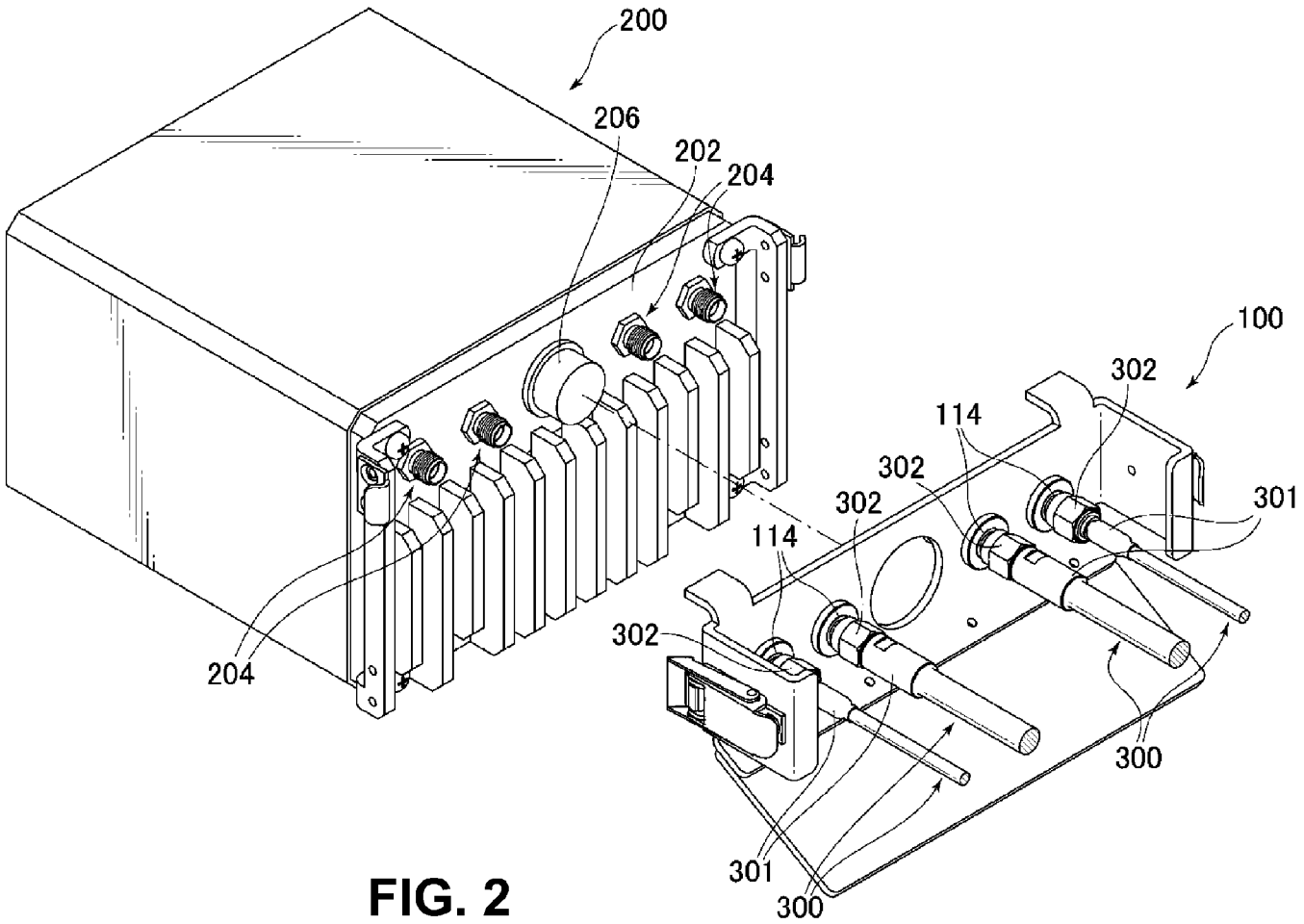
FIG. 2 is a perspective view showing a state where a plurality of cables is connected to a plurality of intermediate connectors of the fitting adapter according to the first embodiment of the present invention.

FIG. 2 is a perspective view showing a state that the plurality of cables 300 is connected to the plurality of intermediate connectors 302 of the fitting adapter 100. To each of the cable connector-side connecting parts 114 of the plurality of intermediate connectors 104 of the fitting adapter 100, the coaxial connector 301 of the cable 300 is connected. The cable connector-side connecting part 114 of the intermediate connector 104 has a threaded part on a cylindrical outer wall. On the other hand, the threaded fastening part 302 of the cable 300 also has a threaded part on a cylindrical inner wall thereof. Upon connection, screwing the threaded fastening part 302 of the cable 300 to the threaded part of the cable connector-side connecting part 114 of the intermediate connector 104, it is achievable to keep and secure the connection between the cable connector-side connecting part 114 of the intermediate connector 104 and the coaxial connector 301 of the cable 400. With this fastening action, it is achievable to obtain stable high-frequency characteristics of the cable 300 connection itself.

As shown in FIG. 2, the plurality of cables 300 is connected to the VNA extenders 200, while being connected to the fitting adapter 100. Therefore, upon measurement of high-frequency characteristics, it is not necessary to reconnect the plurality of cables 300 accompanied by changing the VNA extender 200.

Figure 3:
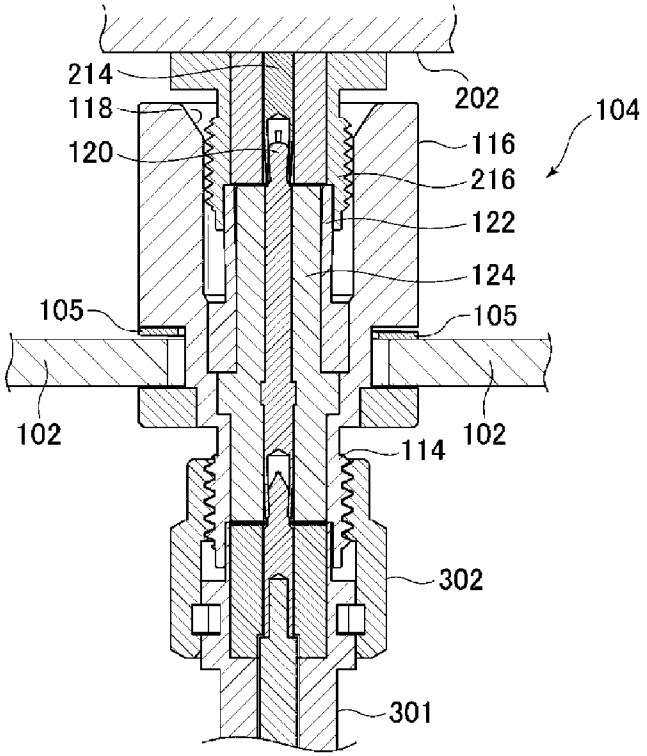
FIGS. 3(*a*) and 3(*b*) are sectional views showing an extender connector of the VNA extender and the intermediate connector taken along a horizontal surface of the VNA extender according to the first embodiment of the present invention, wherein FIG. 3(*a*) shows a state before connecting the intermediate connector, which is provided on the fitting adapter, to the extender connector provided on the VNA extender, and FIG. 3(*b*) shows a state that the intermediate connector on the fitting adapter is connected to the extender connector on the VNA extender.
Figure 3:
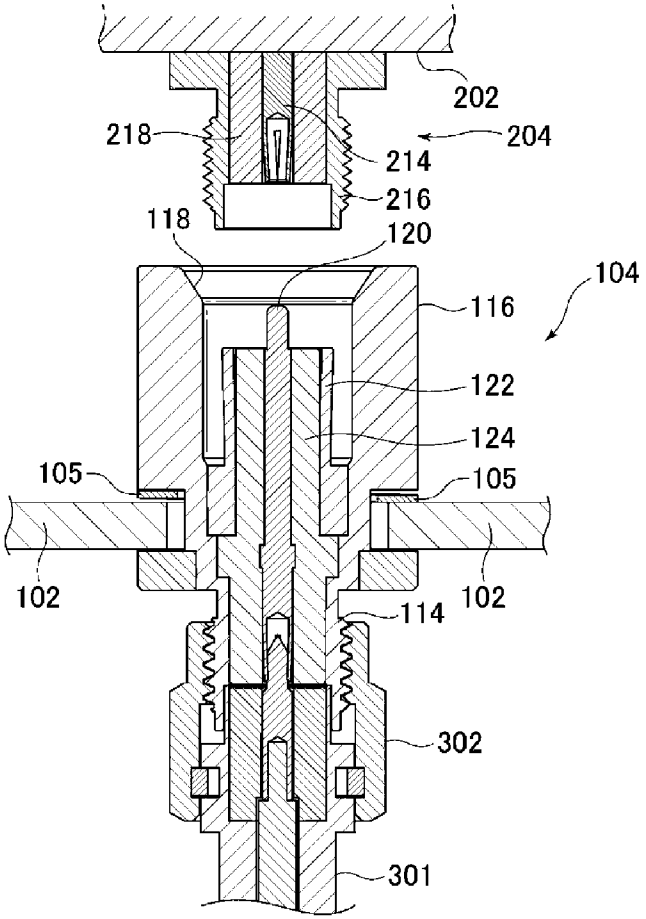

FIGS. 3(*a*) and 3(*b*) are sectional views showing the intermediate connector 104, taken along a direction horizontal to a top surface of the VNA extender 200. FIG. 3(*a*) shows a state before the intermediate connector 104 is connected to the extender connector 204.

To the cable connector-side connecting part 114 of the intermediate connector 104, the coaxial connector 301 of the cable 300 is connected. With the threaded fastening part 302, it is achievable to keep and secure the connection to the coaxial connector 301. Providing a gap from the panel 102, the intermediate connector 104 can penetrate the panel 102 while being in a floating state, and be attached thereto via the spring washer 105, which is an elastic member that generates elastic force in the connectors' fitting direction. The intermediate connector 104 includes a cable connector-side connecting part 114 for connecting between the coaxial connector 301 of the cable 300 and the extender connector-side connecting section 116 for connecting the extender connector 204 of the VNA extender.

Each extender connector-side connecting part 116 has a hallow cylindrical shape, and has a tapered part 118 on an inner side at its end. With the tapered part 118, upon fitting and connecting the fitting adapter 100 to the VNA extender 200, it is achievable to easily guide the extender connector 204 to inside of the extender connector-side connecting part 116. Since there is no threaded portion on the inner wall of the extender connector-side connecting part 116, the extender connector 204 is fitted and connected thereto by pushing inside of the extender connector-side connecting part 116. In short words, this connection is push-on type connection.

Each intermediate connector 104 includes the center conductor 120 provided thereinside, the outer conductor 122, and the dielectric 218. On the other hand, each extender connector 204 provided on the cable connection panel 202 of the VNA extender 200 includes a center conductor 214, an outer conductor 216, and a dielectric 218.

FIG. 3(*b*) shows a state that the intermediate connector 104 is connected to the extender connector 204. Upon connection, the outer conductor 122 provided inside of the intermediate connector 104 and the outer conductor 216 of the extender conductor 204 contact to each other. With the locking mechanisms including the pull-in locks 108 and the engaging portions 212, the connection between the fitting adapter 100 and the VNA extender 200 is secured. Accordingly, tension (the force that pushes each other) is always applied between the intermediate connectors 104 and the extender connectors 204, and thereby it is achievable to keep a state that ends of inner portions of the outer conductors of the connectors contact to each other.

According to the embodiment of providing the spring washers 105 between the intermediate connectors 104 and the panel 102, by securing the connection between the fitting adapter 100 and the VNA extender 200 by the locking mechanisms, the spring washers 105 deform to flattened hoop shapes. The deformed spring washers 105 cause force to recover to the original shapes by elasticity. Therefore, with the force, the pressing the extender connector-side connecting parts 116 to the extender connectors 204, it is achievable to keep the end-touching state.

Furthermore, according to another embodiment, it is also possible to configure the outer conductors 122 of the intermediate connectors 104 to be elastically displaceable. For example, it is possible to configure so as to always generate force that pushes the outer conductors 122 of the intermediate connectors 104 to the outer conductors 216 of the extender connectors 204 upon connecting the connectors, by providing elastic bodies such as coil springs or rubber pieces on contact surfaces. Here, each of the contact surfaces is a contact surface that contacts with at least one of the outer conductor 122, the dielectric 124 and the outer conductor 116 and extends in a direction vertical to the fitting direction. Here, even in the above-described embodiment, in which the elastic bodies are provided on at least one of the pull-in locks 108 and the engaging portions 212, which are the locking mechanisms, it is achievable to maintain the end-touching state similarly to the above.

Figure 4:
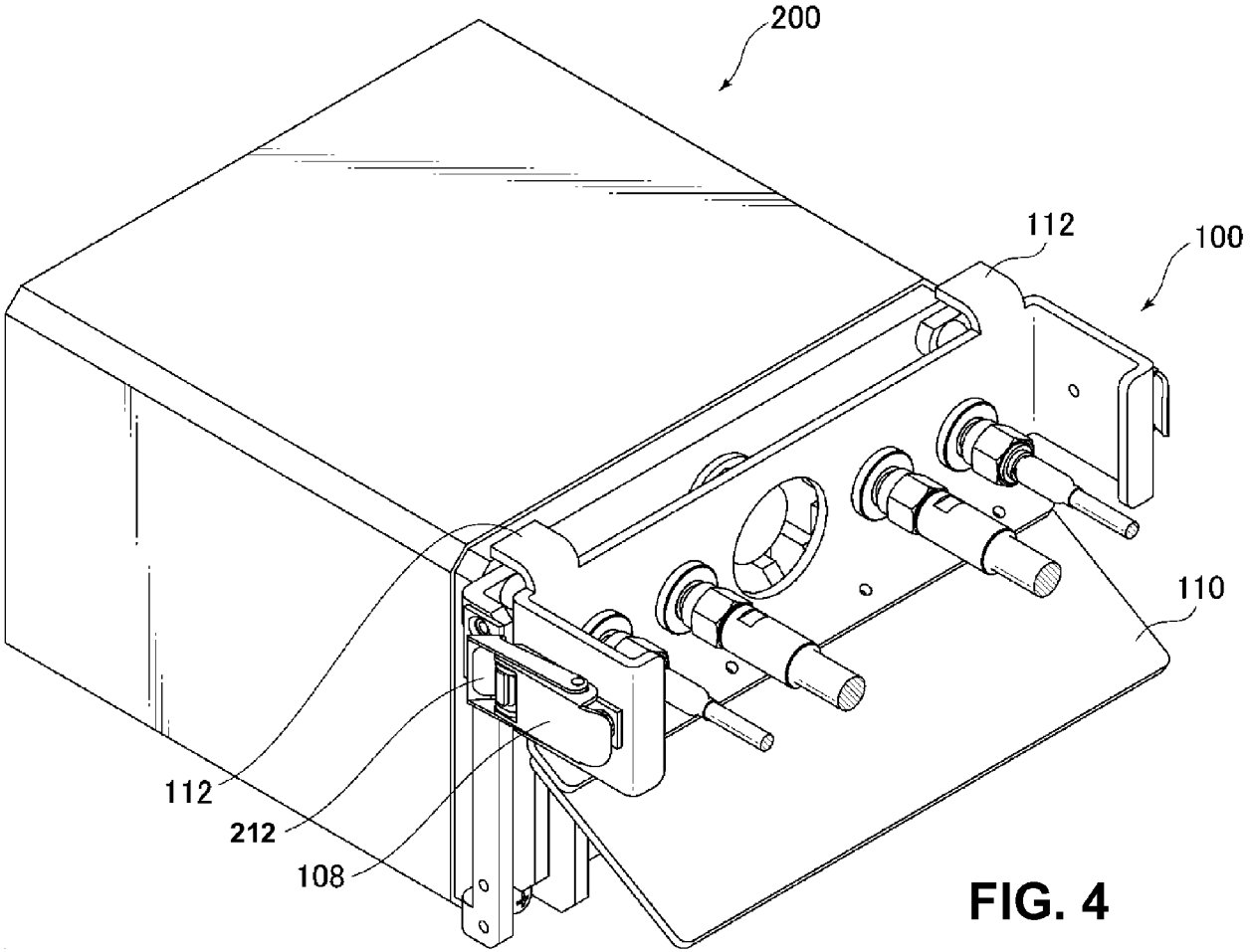
FIG. 4 is a perspective view showing the fitting adapter connected to the VNA extender according to the first embodiment of the present invention.

FIG. 4 shows a state that the fitting adapter is connected to the VNA extender together, in which the plurality of cables 300 is connected to the fitting adapter 100. By hooking the pull rings of the pull-in locks 108 of the fitting adapters 100 onto the engaging portions 212 provided on the sidebars 210 of the VNA extender 200, and pulling the levers of the pull-in locks 108 down, the fitting adapter 100 and the VNA extender 200 push each other. As a result, it is achievable to maintain and secure the connection between the connectors.

Here, upon connecting the fitting adapter 100 in a vertical or horizontally reverse direction, the anti-reverse attachment preventing portion 112 of the VNA extender 200 hit the cable connection panel 202, the heating portion 208, or the like. Therefore, it is possible to prevent such wrong attachment. The anti-reverse attachment preventing portion 112 can be formed in any shape, as long as they can function to prevent reverse connection of the fitting adapter 100 to the VNA extender 200.

Here, if the cable 300 is heated upon connecting the fitting adapter 100 to the VNA extender 200 to conduct measurement of high-frequency characteristics, it could be difficult to accurately measure the characteristics. Therefore, the heat guard 110 is provided at a position so as to block the heat transfer in the cable connection panel 202 (a lower edge of the cable connection panel 202 in the embodiment shown in FIG. 4), in order to protect from heat or hot air the plurality of cables 300 that is connected to the fitting adapter 100 and is hanging down. The heat guard 110 can be formed in any shape as long as the heat guard 110 can block the heat transfer to the cables 300.

FIG. 5 is a top view showing the connected state of FIG. 4. Pushing the fitting adapter 100 to the VNA extender 200 and simply pressing the extender connector-side connecting parts 116 to the extender connector (push-on style) instead of fastening by screwing action, it is achievable to fit and connect the plurality of cables 300 together. Since the connection is made by push-on method instead of fastening by screwing action, upon measurement of high-frequency characteristics, it is achievable to significantly reduce the reconnection work accompanied by changing the VNA extender 200.

In addition, by employing the push-on type connection, it is also possible to solve an issue of unstable connection due to fastening by screwing action. In order to securely maintain and secure the connection, with the locking mechanisms composed of the pull-in locks 108 and the engaging portions 212, the connection between the fitting adapter 100 and the VNA extender 200 are maintained and secured. As a result, the extender connector-side connecting parts 116 of the intermediate connectors 104 and the outer conductors of the extender connectors 204 push each other, being in the end-touching state, so that the fitting and connection are made between the extender connector-side connecting parts 116 of the intermediate connectors 104 and the outer conductors of the extender connectors 204. When there are spring washers 105 provided between the intermediate connectors 104 and the panels 102, upon connecting the connectors, the spring washers 105 will be deformed to a flattened shape as shown in FIG. 5.

FIG. 5 shows operation of the pull-in locks 108, which are locking mechanisms. In FIG. 5, the levers, the pull rings, and the coil springs 109 are shown with broken lines. Each lever is rotatably joined to the fitting adapter 100. Each pull ring is rotatably and slidably joined to the lever, and engages with and disengages from the engaging portion 212. The coil spring 109 is provided as an elastic member that provides energizing force of the pull ring to the lever. The pull-in lock 108 provided on the left-hand side is in a state before hooking the pull ring onto the engaging portion 212. The pull-in lock 108 on the right-hand side is in a state that the pull ring is hooked onto the engaging portion 212 and the lever of the pull-in lock 108 is pulled down, i.e. in a locked state. In the locked state, the coil spring 109 is in a compressed state. With force of recovering to the original state from the compressed state, the elastic force works in a direction to increase the position of the rotational axis of the pull ring. As a result, the fitting adapter 100 and the VNA extender 200 push each other and thereby it is achievable to maintain and secure the connection between the connectors. Accordingly, the high-frequency characteristics of the connection itself between the fitting adapter 100 and the VNA extender 200 can be made stable.

Second Embodiment

A second embodiment of the present invention will be explained next with reference to FIG. 6.

FIG. 6 is a top view showing the fitting adapter 100 connected to the VNA extender 200 according to the second embodiment of the present invention.

As shown in FIG. 6, an engaging portion 150 is disposed on the fitting adapter 100, and a pull-in lock 250 is disposed on the VNA extender 200. Accordingly, the locking mechanism is formed of the pull-in lock 250 and the engaging portion 150.

In the second embodiment, with the locking mechanism formed of the pull-in lock 250 and the engaging portion 150, it is possible to securely connect the fitting adapter 100 to the VNA extender 200. As a result, the extender connector-side connecting parts 116 of the intermediate connectors 104 and the outer conductors of the extender connectors 204 push each other, being in the end-touching state, so that the fitting and connection are made between the extender connector-side connecting parts 116 of the intermediate connectors 104 and the outer conductors of the extender connectors 204.

As described above, in the first and second embodiments of the present invention, the fitting adapter 100 is applicable in electronic devices having a plurality of connectors. For example, it is applicable in the field of measuring high-frequency characteristics of electronic components, electrical circuits, etc. in an object for measurement, using a VNA extender having a plurality of connectors.

The disclosure of Japanese Patent Applications No. 2014-123407, filed on Jun. 16, 2014, is incorporated in the application by reference.

While the present invention has been explained with reference to the specific embodiments of the present invention, the explanation is illustrative and the present invention is limited only by the appended claims.

What is claimed is:

1. A fitting adaptor for fitting a coaxial cable connector to a device connector of an electrical device, comprising:

a panel including an opening portion;

an intermediate connector attached to the panel to be movable relative to the panel;

a locking mechanism disposed on the panel; and an elastic member disposed on at least one of the intermediate connector and the locking mechanism, or between the panel and the intermediate connector, wherein said intermediate connector includes a cable connector side connecting part and a device connector side connecting part so that the elastic member urges the device connector side portion against the device connector, said cable connector side connecting part is engaged with and fitted to the device connector side connecting part through the opening portion, said device connector side connecting part includes a small diameter portion situated in the opening portion, and said small diameter portion has a size smaller than that of the opening portion so that the device connector side connecting part is movable laterally.

2. The fitting adaptor according to claim 1, wherein said locking mechanism includes a pull-in lock having a lever, said elastic member includes a coil spring for urging the pull-in lock when the lever is pulled down.

3. The fitting adaptor according to claim 1, wherein said locking mechanism includes an engaging portion for engaging with a pull-in lock disposed on the electrical device, said pull-in lock including a lever and a coil spring.

4. The fitting adaptor according to claim 1, wherein said panel includes an anti-reverse attachment preventing portion for preventing the fitting adaptor from being attached to the electrical device in a wrong way.

5. A fitting adaptor for fitting a coaxial cable connector to a device connector of an electrical device, comprising:

a panel including an opening portion;

an intermediate connector attached to the panel to be movable relative to the panel;

a locking mechanism disposed on the panel; and an elastic member disposed on at least one of the intermediate connector and the locking mechanism, or between the panel and the intermediate connector, wherein said intermediate connector includes a cable connector side connecting part and a device connector side connecting part so that the elastic member urges the device connector side portion against the device connector, said cable connector side connecting part is engaged with and fitted to the device connector side connecting part through the opening portion, and said panel includes a heat guard for blocking heat generated from a heating portion of the electric device.

6. The fitting adaptor according to claim 1, wherein said cable connector side connecting part includes a screw portion on an outer surface thereof so that the coaxial cable can be screwed to the screw portion.

* * * * *